United States Patent [19]

Kahle et al.

[11] 4,147,422

[45] Apr. 3, 1979

[54] METHOD AND APPARATUS FOR EVACUATING AQUEOUS AMMONIA VAPOR FROM FILM DEVELOPING CHAMBERS

[75] Inventors: Rolf D. Kahle, Saratoga; John W. Meadows, Los Altos, both of Calif.

[73] Assignee: Quantor Corporation, Mountain View, Calif.

[21] Appl. No.: 897,079

[22] Filed: Apr. 17, 1978

[51] Int. Cl.[2] ..... G03D 7/00

[52] U.S. Cl. ..... 354/299; 354/300; 354/324

[58] Field of Search ..... 354/299, 300, 319, 324; 34/32, 34, 36, 37, 72, 242, 155

[56] References Cited

U.S. PATENT DOCUMENTS

| | | | |
|---|---|---|---|
| 3,435,751 | 4/1969 | Goodman et al. | 34/155 |
| 3,545,363 | 12/1970 | Bricher et al. | 34/242 |
| 4,056,824 | 11/1977 | Iiyama et al. | 354/299 |
| 4,062,031 | 12/1977 | Schroter | 354/299 |

*Primary Examiner*—L. T. Hix

*Assistant Examiner*—Alan Mathews

*Attorney, Agent, or Firm*—J. T. Cavender; Wilbert Hawk, Jr.; George J. Muckenthaler

[57] ABSTRACT

A diazo film developer which has a developing chamber that is kept at a temperature above the dew point for the film. Feed rollers disposed adjacent an intake opening of the chamber are maintained at a temperature above the dew point and advance film to be developed to the chamber. Exit rollers at an outlet opening for the chamber withdraw developed film from the chamber. The rollers are sealed with respect to the chamber to prevent the escape of aqueous ammonia vapors. The portion of the exit rollers disposed outside the chamber is subjected to a relatively low temperature airstream to cool the rollers below the dew point for the aqueous ammonia vapor. The exit rollers are continuously rotated so that aqueous ammonia vapor can condense on surface portions of the rollers disposed interiorly of the chamber. The condensate is then transported by the rotating rollers to the exterior of the chamber and the cooled airflow removes, e.g. evaporates the condensate before it is re-introduced into the chamber.

30 Claims, 1 Drawing Figure

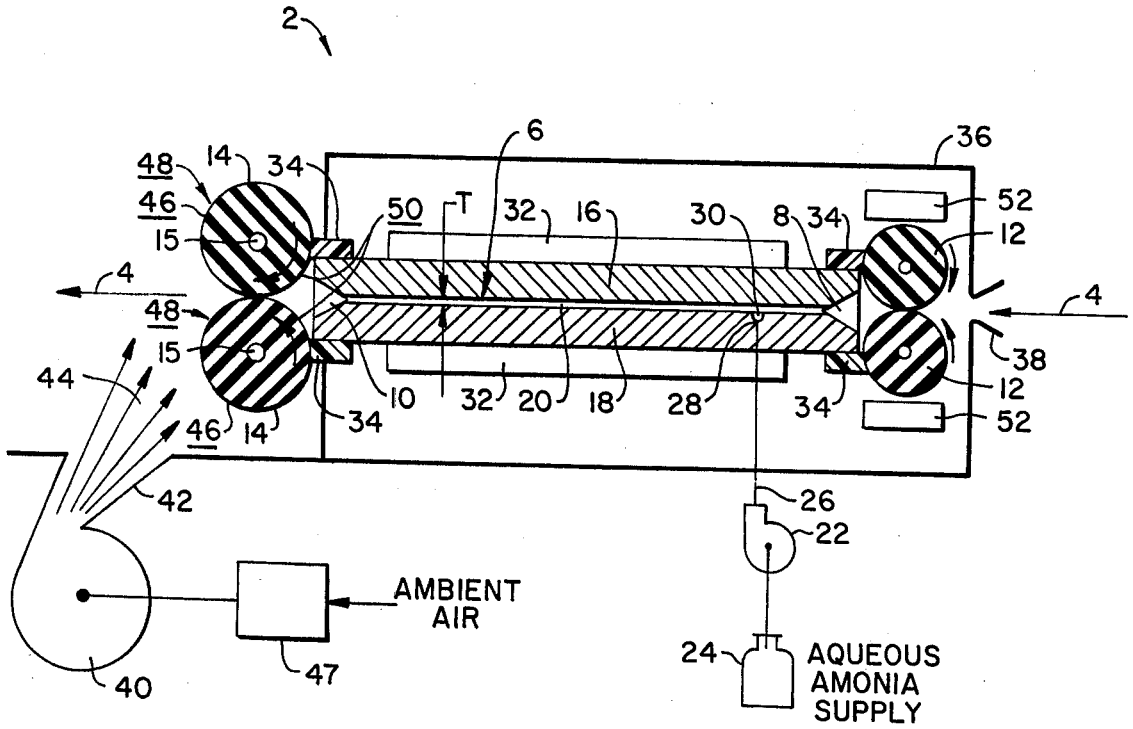
2
6
36
48
14
34
46
50
T
32
16
30
8
34
52
15
12
4
4
48
15
38
44
10
32
20
18
28
34
12
46
14
34
52
42
26
22
AMBIENT
AIR
24
AQUEOUS
AMONIA
SUPPLY
40
47

METHOD AND APPARATUS FOR EVACUATING AQUEOUS AMMONIA VAPOR FROM FILM DEVELOPING CHAMBERS

BACKGROUND OF THE INVENTION

For economic and other reasons, diazo film is increasingly used for making copies of microfiche masters. Generally speaking, diazo film is first exposed and thereafter it is developed in aqueous ammonia vapor. With usage, the vapor must at least be intermittently replenished with fresh vapor. This is particularly important in connection with the recently developed micro-chambers which have physical dimensions only slightly larger than those of the film because there is only a relatively small volume of vapor which, during rates of high film throughput, becomes relatively quickly spent. Thus, in connection with micro-chambers, it is necessary to supply fresh aqueous ammonia vapor on a more or less continuing basis.

Because of their noxious stench, ammonia vapors cannot be discharged into the atmosphere unless the volume is very small. Thus, some other means for removing spent ammonia vapors must normally be devised. In the past, several approaches were employed. In a most simple arrangement, the developing chamber is defined by a pair of opposite, spaced apart platens which are heated so as to maintain the vapor temperature in the gap between them above the dew point of the vapor. The vapors, however, were allowed to escape into a housing which encapsulates the platens. The housing walls are at a lower temperature and aqueous ammonia vapor was permitted to condense thereon. By devising properly arranged guide channels, accumulating aqueous ammonia droplets could be collected in a suitably disposed drain for discharge to a waste ammonia tank or the like.

A shortcoming encountered with this approach is that the overall volume of the housing into which ammonia must be introduced is relatively large so that the ammonia consumption is correspondingly high with only a small portion of the ammonia being actually used for developing the film. Further, because of the large volume, the opening of the developer for repair, maintenance and the like releases significant amounts of ammonia vapor into the surrounding atmosphere which is undesirable. Most significantly, however, the accumulation of aqueous ammonia droplets cannot be well controlled and such droplets might from time to time contact the film being developed in the chamber. Any such contact is highly detrimental to the developing process and normally renders the film unacceptable.

In the past, attempts have also been made to withdraw the aqueous ammonia vapor from the chamber on a more or less continuing basis and to condense the ammonia outside the chamber. Although this overcomes some of the problems mentioned in the preceding paragraph, it requires the installation of relatively complicated and, therefore, costly pumps, conduits and condensers which require constant maintenance and which, unless constantly checked, may leak and release relatively large amounts of ammonia vapors to the surrounding atmosphere.

A still further prior art attempt to remove spent ammonia from the developing chamber is to place one or more condenser plates into the chamber so that aqueous ammonia vapor can condense thereon. The condensate is then withdrawn by gravity through properly arranged channels, drainage holes and the like. Again, a problem encountered with such an arrangement is the fact that the removal of the vapor from the chamber requires the formation of discreet aqueous ammonia droplets. Only after the droplets have reached a sufficient size so that they can gravitationally run off the condenser plates is it possible to remove the spent ammonia from the chamber. However, the presence of such droplets in the chamber always brings with it the danger that they be contacted by the film which, as above described, damages the film.

From the foregoing, it is apparent that up to now difficulties have been encountered in handling the aqueous ammonia in diazo film developers. Economically feasible approaches often compromised the quality of the film and could lead to excessive rejects. On the other hand, methods for handling the ammonia which did not compromise the quality of the film were relatively expensive. Thus, there is presently a need for an efficient, low cost ammonia handling system for diazo film developers which assures high quality developed diazo film.

SUMMARY OF THE INVENTION

The present invention overcomes the shortcomings found in prior art diazo film developers and in particular the shortcomings which resulted from the manner in which the aqueous ammonia vapor in the developing chamber was replenished. Generally speaking, the present invention accomplishes this by condensing relatively minute amounts of aqueous ammonia vapor on a relatively small surface which is continuously moved into and out of the developing chamber. While the surface is disposed inside the chamber, microscopic droplets form on the surface. Before the droplets can become of such size that they may damage film being developed in the chamber the surface is moved outside the chamber and the droplets are removed therefrom. In the preferred embodiment of the invention the removal of the droplets from the surface is by evaporation, although other methods for their removal can be employed if desired.

Speaking in more concrete terms, the present invention contemplates the intermittent or continuous introduction of aqueous ammonia vapor into a developing chamber which is sealed from the exterior. Feed rollers for advancing film to be developed into the chamber are disposed proximate an intake opening of the chamber while exit rollers for withdrawing developed film from the chamber are disposed proximate an outlet opening of the chamber. The rollers are sealed with respect to the chamber so as to prevent the escape of vapor to the exterior and the chamber is heated to a temperature sufficiently elevated so as to prevent the formation of vapor condensate within the chamber, i.e. to above the dew point for the aqueous ammonia vapor. The feed rollers are maintained at about the same temperature as the chamber so as to prevent the formation of condensate thereon.

The exit rollers, however, are positioned so that a first surface portion of each roller is disposed inside the chamber while a second surface portion of each roller is disposed exteriorly of the chamber. The temperature of the exit rollers is sufficiently low so that vapor in the chambers condenses on the first mentioned surface portions of the exit rollers. By virtue of the continuous rotation of the exit rollers, condensate formed on the roller surfaces is continuously moved outside the chamber in minute amounts, that is in the form of only microscopic droplets which are too small to either accumulate into larger droplets or to in any manner damage the film if they come in contact therewith.

Once the condensate on the rollers is on the exterior of the chamber, it is removed therefrom. Depending on the air temperature, humidity, etc. this can be accomplished by simply permitting the condensate on the rollers to evaporate before it can re-enter the chamber with the rotating roller surface. In accordance with one aspect of the invention, however, the condensate removal and the cooling of the rollers is performed in a single operation by passing an airstream over the exterior roller surface portions which has a temperature below the dew point for the vapor. Depending on the particular circumstances, air temperature, humidity conditions, etc. this may be an ambient airstream, a heated or a cooled airstream. To enhance the cooling and condensate evaporation efficiency, an air fan may be provided which directs the airstream against the exterior roller surface portions.

Additionally, the developing chamber of the present invention is constructed so as to assure that no condensate forms at any other location within the chamber along the film travel path. Thus, the chamber itself is appropriately heated. Similarly, the upstream feed rollers are heated, either by encapsulating them in a housing with conventional developing platens or by independently heating the rollers either internally or by subjecting them to a heated airstream, for example. When encapsulated with the platen a frequently sufficient transfer takes place between the platens and the rollers so as to eliminate the need for separately heating the feed rollers.

From the foregoing, it should be apparent that the present invention eliminates the need for complicated ammonia vapor withdrawal conduits, pumps, and the like to prevent the formation of aqueous ammonia droplets within the chamber which may contact and damage or destroy the film being developed therein. While achieving the same effect as vapor withdrawal systems, that is eliminating the formation of ammonia droplets which could damage the film within the developing chamber, the present invention also eliminates the need for ammonia condenser plates or walls, drainage passages and openings, etc. Instead, it employs the already present exit rollers which withdraw developed film from the chamber as a vehicle for withdrawing the spent ammonia from the chamber. By properly constructing the developer, the most that is needed is the provision of a cooling-evaporation fan which directs a roller cooling and condensate evaporating airstream against the exterior portions of the exit rollers. Thus, with little or no additional costs, the present invention accomplishes that which in the past required expensive equipment. Consequently, the present invention facilitates the economic large scale use of diazo film in connection with microfiche copiers and the like.

BRIEF DESCRIPTION OF THE DRAWINGS

The drawing schematically illustrates an aqueous ammonia developer for diazo films constructed in accordance with the present invention.

DESCRIPTION OF THE PREFERRED EMBODIMENTS

Referring to the drawing, a developer 2 constructed in accordance with the present invention for developing a diazo-type microfiche 4 in an aqueous ammonia atmosphere generally comprises a developing chamber 6 having an intake opening 8 and an outlet opening 10. The microfiche is advanced in a downstream direction, that is to the left as seen in the drawing, by a pair of feed rollers 12 disposed proximate the intake opening. A pair of corresponding exit rollers 14 is positioned adjacent outlet opening 10. They are driven by shafts 15 and they withdraw the microfiche after it has been developed in the chamber. The chamber itself is defined by parallel, spaced apart upper and lower platens 16, 18, respectively, which between them define a gap 20 of a height "T" and of a width dimensioned so as to permit the passage of microfiche 4 through the gap. A pump 22 has an intake fluidly connected to an aqueous ammonia supply 24 and feeds aqueous ammonia via supply line 26 to an ammonia discharge port 28 in the lower platen 18. The site of the lower platen facing gap 20 preferably includes a transverse groove 30 which communicates with port 28 and distributes the ammonia over the full width of the chamber.

Heaters 32 heat platens 16, 18 to a temperature which is sufficiently above the dew point for the aqueous ammonia discharged by port 28 so as to cause the discharge of the aqueous ammonia in its vapor form and to maintain the aqueous ammonia in the developing chamber in its vapor state. Further, seal strips 34 constructed of a suitable material such as teflon, for example, are provided to seal the ends of platens 16, 18 against the feed and exit rollers 12, 14 so as to seal the developing chamber from the exterior. In the illustrated embodiment the seal strips are secured to the platens and they extend over the full length of the rollers. Spring means (not shown) may be provided to urge the seal strips against the rollers. Finally, the platens 16, 18, the feed rollers 12 and the heaters 32 are encapsulated within a housing 36 which, adjacent its upstream end, includes an intake chute 38 through which a microfiche to be developed can be inserted into engagement with the feed rollers.

The operation of developer 2 is as follows. During an initial start-up period, heaters 32 are energized to bring the platens and the developing chamber to their operating temperature, that is above the dew point for the aqueous ammonia. After the temperature has been reached, pump 22 can be activated to introduce aqueous ammonia into the developing chamber 6. To minimize ammonia consumption and to maximize the developing efficiency, it is preferred that the gap width "T" is closely controlled. In a presently preferred embodiment the gap width is no more than about 0.02" for accommodating a microfiche having a thickness of between 0.003 to about 0.007". At the indicated dimensions, microfiche is readily transported in a downstream direction without undesirable interference from the opposing platen surfaces.

Pump 22 may be selected so that it pumps a very small volume of aqueous ammonia which is selected to provide just enough ammonia to develop the fiches at whatever rate they pass through the chamber. Alternatively, the metering pump may be an intermittently operating pump which is selectively activated in response to an approaching microfiche to be developed. In an alternative operational mode, a valve (not shown) may be interposed in supply line 26 and be coupled with suitable sensors (not shown) to temporarily open the valve to flow the desired amount of ammonia to discharge port 28. As the ammonia approaches the discharge port, it is heated by lower platen 18 and evaporates so that it is discharged into the developing chamber in its vapor state.

The developer is now ready for use. After a microfiche 4 has been exposed, it is entered through chute 38 until feed rollers 12 grasp it. The rollers advance the microfiche into developing chamber 6 where the aqueous ammonia vapor develops the fiche. The leading edge of the fiche is then grasped by exit rollers 14 which withdraw the fiche from the chamber for discharge into a suitable receptacle (not shown).

The developing of the fiche consumes ammonia. Thus, it is necessary to remove from the chamber spent aqueous ammonia and replenish it with fresh aqueous ammonia in the above outlined manner. The present invention accomplishes the removal of spent ammonia by establishing in effect an equilibrium flow, that is by removing aqueous ammonia at the same rate at which it is introduced into the chamber.

Exit roller 14 accomplish the actual removal of the spent aqueous ammonia from the chamber as follows. The temperature of the exit rollers is maintained relatively low, that is below the dew point for the ammonia. This may be accomplished by placing the rollers in a relatively cool atmosphere. The cooling of the exit rollers is enhanced by providing a fan 40 which has a discharge nozzle 42 that directs an ambient airstream 44 towards exterior surface portions 46 of the cylindrical outer surface 48 of the rollers. A cooler (or heater) 47 may be provided to regulate the temperature of the airstream 44.

It will be observed that at all times there is an interior surface portion 50 of the exit rollers which is disposed within, i.e. which forms the downstream boundary for the developing chamber 6. The temperature of the exit rollers is below the dew point for the aqueous ammonia in the developing chamber. Accordingly, aqueous ammonia in general and spent aqueous ammonia in particular, condenses on the interior surface portions 50 of the exit rollers. Since the rollers rotate continuously and the interior surface portion 50 is relatively small, i.e. it is less than 50% of the entire cylindrical surface of the rollers, only minute amounts of aqueous ammonia condensate can form on the interior surface portion until the surface portion is rotated to the exterior of the developing chamber. The minute amounts of condensate are present on the interior surface portion in the form of microscopic droplets that are far too small to coalesce into larger droplets and which, if they contacted a fiche disposed between the exit rollers will not damage the fiche. Furthermore, the small droplet size prevents the droplets from being squeeged off the rollers along their common contact line. Their accumulation within the chamber is thus prevented.

In fact, the small droplets on the interior roller surface portions 50 pass with the rotating surface past the contact line between the rollers to the exterior of the developing chamber. Once the droplets are on the outside of the chamber they are readily removed, in accordance with the present invention preferably with the same airstream 44 which is used to cool the exit rollers by causing the evaporation of the minute droplets before they can re-enter the developing chamber with the rotating rollers.

Although the above-described removal of aqueous ammonia vapors from the developing chamber does not as such discriminate between spent ammonia and fresh ammonia, the relative remote location of the exit rollers from the aqueous ammonia discharge port 28, which is proximate the intake opening 8, has a tendency to preferentially remove spent ammonia because there is a slow circulation of ammonia vapors from the discharge port towards the exit rollers and the progressive development of a fiche passing through the chamber uses up increasing amounts of ammonia. This assures a highly efficient use of the ammonia and further minimizes the amounts of ammonia discharged to the atmosphere.

Although the aqueous ammonia removal from the developing chamber in accordance with the present invention is generally applicable to any developer, it is particularly well suited for the earlier discussed microdeveloping chambers which have minimal chamber volumes and, therefore, minimal ammonia requirement. This translates into small volumes of ammonia condensate which must be removed from the chamber and for which the removal in accordance with the present invention is particularly well-suited.

To prevent the formation of aqueous ammonia condensate on the feed rollers 12, the temperature of the latter is maintained above the aqueous ammonia dew point, e.g. at about the same temperature as that of the developing chamber. For this purpose, the feed rollers are disposed within housing 36. For most cases, their placement within the housing is sufficient to maintain the necessary temperature through heat transfer from the heated platens 16, 18. However, additional heaters 52 may be provided for independently heating the feed rollers to the desired temperature.

We claim:

1. In a method for developing a film in an aqueous ammonia atmosphere including the steps of providing a substantially sealed developing chamber; advancing film to be developed in a downstream direction through an intake opening of the chamber into the chamber; withdrawing the film in a downstream direction from the chamber through an outlet opening of the chamber; at least intermittently introducing into the chamber aqueous ammonia; at least intermittently removing from the chamber spent aqueous ammonia; and maintaining the interior of the chamber at a sufficiently elevated temperature to maintain the aqueous ammonia in its vapor state, the improvement to the step of removing comprising the steps of: providing a body defining at least one surface; maintaining the temperature of the surface sufficiently below the temperature of the chamber interior to cause the formation of minute aqueous ammonia condensate droplets thereon; substantially continuously moving the surface into and out of the chamber so as to collect aqueous ammonia condensate on the surface when the surface is disposed within the chamber; and removing such condensate from the surface while the surface is on the exterior of the chamber and before it is re-introduced into the chamber.

2. A method according to claim 1 wherein the step of removing the condensate from the surface comprises the step of evaporating the condensate from the surface.

3. A method according to claim 2 wherein the evaporating step comprises the step of directing an airflow onto the surface while the surface is disposed exteriorly of the chamber.

4. A method according to claim 3 wherein the airflow has a temperature less than the temperature of the chamber interior to thereby simultaneously cool the surface below the interior chamber temperature.

5. A method according to claim 1 wherein the body comprises a roller having a generally cylindrical surface positioned relative to the chamber so that a first portion of the surface is disposed within the chamber and a second portion of the surface is disposed outside the chamber; and wherein the step of substantially continuously moving the body comprises the step of rotating the roller about its axis so as to continuously move the surface portions between the chamber interior and exterior.

6. A method according to claim 5 including a second roller substantially parallel to the first mentioned roller and having a generally cylindrical surface in contact with the surface of the first roller; and wherein the step of withdrawing the film from the chamber comprises the steps of rotating the rollers in opposite directions and grasping film to be withdrawn from the chamber between the rollers so as to advance the film in a downstream direction past the rollers to the exterior of the chamber.

7. A method according to claim 6 wherein the second roller is also positioned so that a first portion of its surface is disposed within the chamber and a second portion is disposed outside the chamber, and including the steps of continuously rotating the rollers about their respective axes, and directing a relatively cool airflow against the second surface portions of the rollers to thereby remove from the surfaces aqueous ammonia condensate adhering thereto and to cool the surfaces to a temperature below the ammonia vapor temperature in the chamber.

8. A method according to claim 1 wherein the step of substantially continuously moving comprises the step of moving the surface at a rate so that the minute droplets are prevented from coalescing while disposed within the chamber.

9. A method for developing diazo-type film in an aqueous ammonia atmosphere comprising the steps of: providing a developing chamber and introducing into the chamber controlled amounts of aqueous ammonia vapor; providing a pair of feed rollers which define an intake opening for the chamber; providing a pair of exit rollers which define an outlet opening for the chamber; sealing the rollers with respect to the chamber so as to prevent the escape of vapor to the exterior; heating the chamber interior to a temperature sufficiently elevated so as to prevent the formation of vapor condensate within the chamber; rotating the rollers so that film to be developed and grasped by the inlet rollers is advanced into the chamber and thereafter withdrawn therefrom by the exit rollers; lowering the temperature of the exit rollers sufficiently so that vapor in the chamber condenses on surface portions of the exit rollers disposed within the chamber; and removing vapor condensate on the surfaces of the exit rollers while disposed outside the chamber; whereby a continuous removal of vapor condensate from the chamber is effected and the formation of coalesced condensate droplets within the chamber and a contact between such coalesced droplets and film being developed in the chamber is prevented.

10. A method according to claim 9 wherein the step of removing the condensate comprises the step of blowing air onto surface portions of the exit rollers disposed exteriorly of the chamber.

11. A method according to claim 10 wherein the step of lowering the temperature of the exit rollers comprises the step of blowing air against the rollers having a temperature less than the temperature on the interior of the chamber.

12. A method according to claim 11 wherein the step of blowing air comprises the step of blowing ambient air.

13. A method according to claim 9 wherein the chamber includes first and second, parallel, spaced apart platens defining a gap therebetween through which film to be developed is advanced; wherein the heating step comprises the step of heating at least one of the platens; and further including the step of heating the feed rollers to a sufficient temperature to prevent the formation of vapor condensate on surfaces of the inlet rollers.

14. A method according to claim 13 wherein the step of heating the feed rollers comprises the step of heating at least one platen only, and transferring heat from the platen to the feed rollers.

15. A method according to claim 14 including the step of shielding the feed rollers from ambient air.

16. A method according to claim 9 including the step of independently heating the feed rollers to a sufficient temperature to prevent the formation of vapor condensate on the feed rollers.

17. In apparatus for the developing film in an aqueous ammonia vapor atmosphere having a developing chamber including an intake opening and an outlet opening; means for introducing the film through the intake opening into the chamber; exit rollers positioned at the outlet opening for withdrawing the film from the chamber; means for supplying aqueous ammonia to the chamber; means for maintaining the temperature of the aqueous ammonia in the chamber above its dew point; and means for removing from the chamber aqueous ammonia so as to enable the circulation of fresh ammonia through the chamber, the improvement to the ammonia removing means comprising: means positioning the exit rollers so that a first roller surface portion is disposed within the chamber and a second surface portion is disposed outside the chamber; means for imparting rotation to the rollers; and means for maintaining the temperature of the rollers below the dew point for the aqueous ammonia vapor in the chamber; whereby relatively small amounts of aqueous ammonia condenses on the first roller surface portion and, while adhering to the roller surface, is transported to the exterior of the chamber for removal before the surface portion is reintroduced into the chamber to thereby continuously withdraw small amounts of ammonia vapor and enable a substantially continuous aqueous ammonia circulation through the chamber while preventing the accumulation of ammonia condensate droplets in the chamber.

18. Apparatus according to claim 17 including means for removing from the feed rollers aqueous ammonia condensate adhering thereto.

19. Apparatus according to claim 18 wherein the means for removing the condensate from the roller surface comprises means for flowing an airstream over the second surface portion of the rollers to therewith evaporate the aqueous ammonia condensate on the surface before its reintroduction into the chamber.

20. Apparatus according to claim 17 wherein the means for maintaining the roller temperature below the dew point comprises means for subjecting the second surface portions of the rollers to an airstream of a temperature below the dew point of the aqueous ammonia.

21. Apparatus according to claim 20 wherein the subjecting means comprises means for flowing an ambient airstream over the second roller surface portions, which simultaneously causes the removal of aqueous ammonia condensate adhering to the roller surfaces.

22. Apparatus for developing film in an aqueous ammonia atmosphere comprising: a micro-chamber defined by first and second, spaced apart platens terminating in an upstream inlet opening and a downstream outlet opening and defining therebetween a gap having a thickness only slightly larger than the thickness of the film; feed rollers for advancing film to be developed into the chamber disposed proximate the inlet opening; exit rollers for withdrawing developed film from the chamber and disposed proximate the outlet opening; means operatively connected with the platens and the rollers for sealing the gap between the platens from the exterior; means for introducing into the gap aqueous ammonia vapor; means for maintaining the interior of the chamber at a sufficient temperature so as to cause the aqueous ammonia to remain in its vapor state; means for substantially continuously rotating the exit rollers; means for cooling the exit rollers to a sufficiently low temperature so that aqueous ammonia vapor condenses on surfaces of the rollers and is thereby carried to the exterior of the chamber as the exit rollers rotate; and means for removing from the exit rollers aqueous ammonia condensate while the condensate is disposed exteriorly of the chamber and before it can reenter the chamber; whereby aqueous ammonia is substantially continuously removed from the chamber in very small quantities and the formation of aqueous ammonia droplets within the chamber and on the rollers of a size which can damage the film is prevented.

23. Apparatus according to claim 22 wherein the means for cooling the rollers and the means for removing the aqueous ammonia condensate from the roller surfaces comprises means for subjecting portions of the roller surfaces disposed exteriorly of the chamber to ambient air.

24. Apparatus according to claim 23 wherein the subjecting means includes means for generating an ambient airstream past the roller surfaces.

25. Apparatus according to claim 24 wherein the generating means comprises an air fan.

26. Apparatus according to claim 24 including means for cooling the airflow before it reaches the roller surfaces.

27. Apparatus according to claim 22 including means for maintaining the temperature of the feed rollers sufficiently high so as to prevent aqueous ammonia vapor from condensing on the feed rollers.

28. Apparatus according to claim 27 including a housing shielding the feed rollers from substantial contact with ambient air; whereby a cooling of the feed rollers to a temperature which would cause the formation of aqueous ammonia condensate on the feed rollers is prevented.

29. Apparatus according to claim 22 wherein the first surface portion of the exit rollers is smaller than the second surface portion.

30. Apparatus according to claim 22 wherein the second surface portions comprise more than 50% of the total surface of each exit roller.

* * * * *